US006823967B1

(12) United States Patent
Hoi et al.

(10) Patent No.: US 6,823,967 B1
(45) Date of Patent: Nov. 30, 2004

(54) LUBRICATING APPARATUS FOR DRY SUMP TYPE ENGINE

(75) Inventors: Yosuke Hoi, Saitama (JP); Kazuhiko Tomoda, Saitama (JP); Hitoshi Yokotani, Saitama (JP); Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/714,144

(22) Filed: Nov. 17, 2000

(30) Foreign Application Priority Data

Nov. 19, 1999 (JP) ..... 11-329463

(51) Int. Cl.[7] ..... F01M 1/06
(52) U.S. Cl. ..... 184/6.9
(58) Field of Search ..... 184/6.5, 6.9, 6.8, 184/6.13, 6.17; 123/90.33, 196 R, 196 A, 196 CP

(56) References Cited

U.S. PATENT DOCUMENTS 4,086,981 A * 5/1978 Mitsui ..... 184/1.5
4,638,856 A * 1/1987 Yamanaka et al. ..... 165/119
4,813,408 A * 3/1989 Katsumoto et al. ... 123/196 AB
4,852,532 A * 8/1989 Bishop ..... 123/190 BD
4,928,641 A * 5/1990 Niizato et al. ..... 123/196 M
4,942,855 A * 7/1990 Muto ..... 123/196 R
5,031,598 A * 7/1991 Ueda et al. ..... 123/559.3
5,231,961 A * 8/1993 Shimada et al. ..... 123/41.44
5,249,556 A * 10/1993 Emmitt ..... 123/196 CP
5,333,578 A * 8/1994 Shimura et al. ..... 123/90.17
5,339,776 A * 8/1994 Regueiro ..... 123/196 AB
5,472,360 A * 12/1995 Prasse et al. ..... 440/88 L
5,778,848 A * 7/1998 Takahashi et al. .... 123/196 AB
5,951,343 A * 9/1999 Nanami et al. ..... 114/55.51
6,158,543 A * 12/2000 Matsuto et al. ..... 180/220
6,182,624 B1 * 2/2001 Ozeki ..... 123/195 A
6,192,682 B1 * 2/2001 Smothers et al. ..... 60/488
6,554,104 B2 * 4/2003 Ohyama et al. ..... 184/6.28

FOREIGN PATENT DOCUMENTS

JP 4183909 A * 6/1992
JP 988538 A * 3/1997
JP 9-301286 11/1997
WO WO-9914109 A * 3/1999

OTHER PUBLICATIONS

Abstract and Drawing for SU–1468087.*

* cited by examiner

*Primary Examiner*—Robert A. Siconolfi
*Assistant Examiner*—Melanie Torres
(74) *Attorney, Agent, or Firm*—Birch, Stewart, Kolasch & Birch, LLP

(57) ABSTRACT

To enhance the responsiveness of a relief valve, to lower the height of an engine, and to remove foreign matter entrapped in oil. A cylindrical relief valve for a dry sump type engine is disposed in parallel to a main gallery which is disposed in parallel to a crank shaft. Alternatively, the relief valve is disposed in an oil tank. Furthermore, a strainer for straining oil recovered in the oil tank is provided in the oil tank.

2 Claims, 9 Drawing Sheets

FIG.7(a)
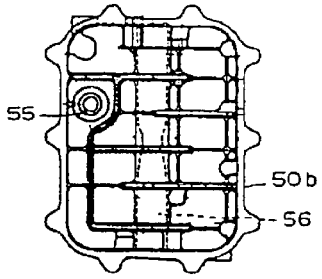
FIG.7(d)
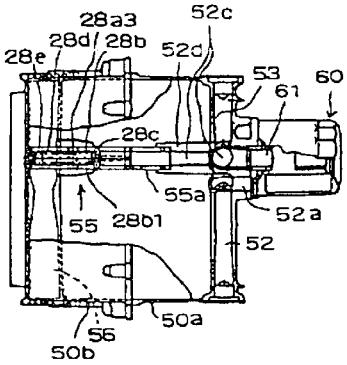
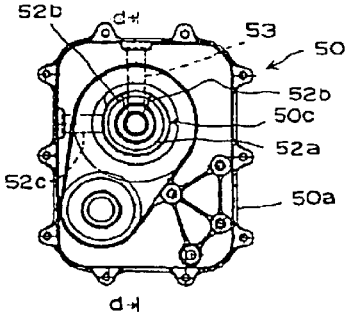
FIG.7(b)
FIG.7(c)
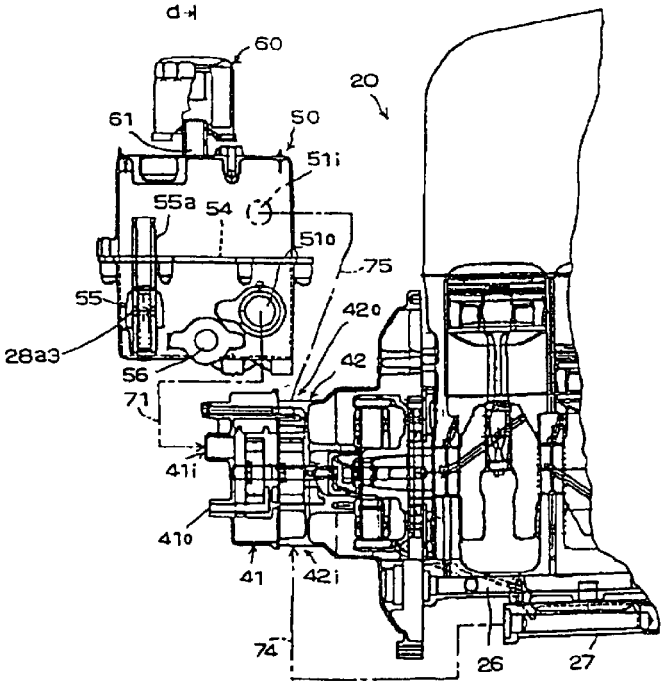

LUBRICATING APPARATUS FOR DRY SUMP TYPE ENGINE

BACKGROUND OF THE INVENTION

1. Field of the Invention

The present invention relates to a lubricating apparatus for a dry sump type engine. In particular, the present invention relates to a lubricating apparatus for a dry sump type engine for use in a small-sized boat.

2. Description of Related Art

A lubricating apparatus for a dry sump type engine has been disclosed, for example, in Japanese Patent Laid-open No. Hei 9-301286.

FIGS. 8 and 9 of the present application illustrate a dry sump type engine as disclosed in the above-described document. This engine, designated by reference numeral 1, is mounted on a small-sized planing boat.

The engine 1 is provided with an oil supply pump 2 (see FIG. 9) for supplying oil from an oil tank 4 into the engine 1, and an oil recovery pump 3 for recovering oil used for lubricating the inside of the engine 1 to the oil tank 4.

Such a lubricating apparatus for a dry sump type engine is advantageous in that since an oil pan of the engine 1 can be decreased in size, the height of the engine 1 can be lowered.

The above-described document does not disclose a relief valve. A relief valve is used for adjusting the hydraulic pressure generated in an oil pump (particularly, in an oil supply pump). Conventionally, a cylindrical relief valve has been disposed perpendicularly to a main gallery which is disposed in parallel to a crank shaft of an engine.

SUMMARY OF THE INVENTION

In the related art dry sump type engine, since the cylindrical relief valve is disposed perpendicularly to the main gallery which is disposed in parallel to the crank shaft as described above, it is problematic, since a path extending from the main gallery to the relief valve increases in size, with the result that the responsiveness of the relief valve becomes poorer.

A first object of the present invention is to solve the above problem and to provide a lubricating apparatus for a dry sump type engine, which is capable of enhancing the responsiveness of a relief valve.

In the related art dry sump engine, since the relief valve is disposed perpendicularly to the main gallery which is disposed in parallel to the crank shaft as described above, it is problematic, since the height of the engine becomes correspondingly larger.

A second object of the present invention is to solve the above object and to provide a lubricating apparatus for a dry sump type engine, which is capable of lowering the height of the engine.

In the related art lubricating apparatus for a dry sump type engine, no strainer is provided in an oil tank. Accordingly, it is impossible to remove foreign matters entrapped in the oil.

A third object of the present invention is to solve the above problem and to provide a lubricating apparatus for a dry sump type engine, which is capable of removing foreign matters entrapped in oil.

To achieve the above first object, according to a first embodiment, there is provided a lubricating apparatus for a dry sump type engine, wherein a cylindrical relief valve for a dry sump type engine is disposed in parallel to a main gallery which is disposed in parallel to a crank shaft of the engine.

To achieve both the above first and second objects, according to a second aspect of the first embodiment, in addition to the configuration according to the first embodiment, the relief valve is disposed in the horizontal direction.

To achieve the second object, according to a second embodiment, there is provided a lubricating apparatus for a dry sump type engine, wherein a relief valve for a dry sump type engine is provided in an oil tank.

To achieve the third object, according to a third embodiment, there is provided a lubricating apparatus for a dry sump type engine, wherein a strainer for straining oil recovered in an oil tank for a dry sump type engine is provided in the oil tank.

According to the lubricating apparatus for a dry sump type engine according to the first embodiment, since the cylindrical relief valve is disposed in parallel to the main gallery which is disposed in parallel to the crank shaft of the engine, a path extending from the main gallery to the relief valve can be shortened, as compared with the related art structure in which the cylindrical relief valve is disposed perpendicularly to the main gallery which is disposed in parallel to crank shaft.

This makes it possible to enhance the responsiveness of the relief valve, and hence to readily control the hydraulic pressure in the main gallery to be kept at a suitable value.

According to the lubricating apparatus for a dry sump type engine according to the second aspect of the first embodiment, since the relief valve is disposed in the horizontal direction in the lubricating apparatus for a dry sump type engine according to the first embodiment, the height of the engine can be lowered and thereby the center of gravity of the engine can be lowered, as compared with the related art structure in which the relief valve is disposed in the vertical direction.

According to the lubricating apparatus for a dry sump type engine according to the second embodiment, since the relief valve for a dry sump type engine is provided in the oil tank, the height of the engine can be lowered and thereby the center of gravity of the engine can be lowered, as compared with the structure in which the relief passage and the relief valve are provided in the engine.

In addition, since oil is directly discharged in the oil tank, it is possible to obtain the following function and effect:

In the structure in which the relief valve is provided in the engine and oil is discharged in the engine, scattered oil in the engine is increased to reduce the oil recovery rate, with a result that it is required to increase the overall amount of oil to be circulated.

On the contrary, according to the lubricating apparatus for a dry sump type engine according to the second embodiment, since the relief valve is provided in the oil tank and oil is directly discharged in the oil tank, it is possible to improve the oil recovery rate and hence to reduce the overall amount to be circulated.

According to the lubricating apparatus for a dry sump type engine according to the third embodiment, since the strainer for straining oil recovered in the oil tank is provided in the oil tank, foreign matters entrapped in the oil can be removed by the strainer.

The strainer is also effective for separation of air from oil. The strainer provided in the oil tank is further advantageous for ease of maintenance as compared with the strainer provided in the engine according to the related art.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6(*b*) is a plan view of a body; FIG. 6(*c*) is a sectional view taken on line c-c of FIG. 6(*b*); and FIG. 6(*d*) is a sectional view taken on line d-d of FIG. 6(*b*);

FIGS. 7(*a*) to 7(*d*) are views showing an essential portion of a second embodiment of a lubricating apparatus for a dry sump type engine of the present invention, wherein FIG. 7(*a*) is a schematic plan view of a lower case 50*b* of an oil tank 50 from which an upper case 50*a* is removed; FIG. 7(*b*) is a schematic plan view of the oil tank 50; FIG. 7(*c*) is a schematic vertical sectional view showing the oil tank 50 and part of the engine 20; and FIG. 7(*d*) is a schematic sectional view taken on line d-d of FIG. 7(*b*);

DESCRIPTION OF THE PREFERRED EMBODIMENTS

Hereinafter, embodiments of the present invention will be described with reference to the drawings.

Figure 1:
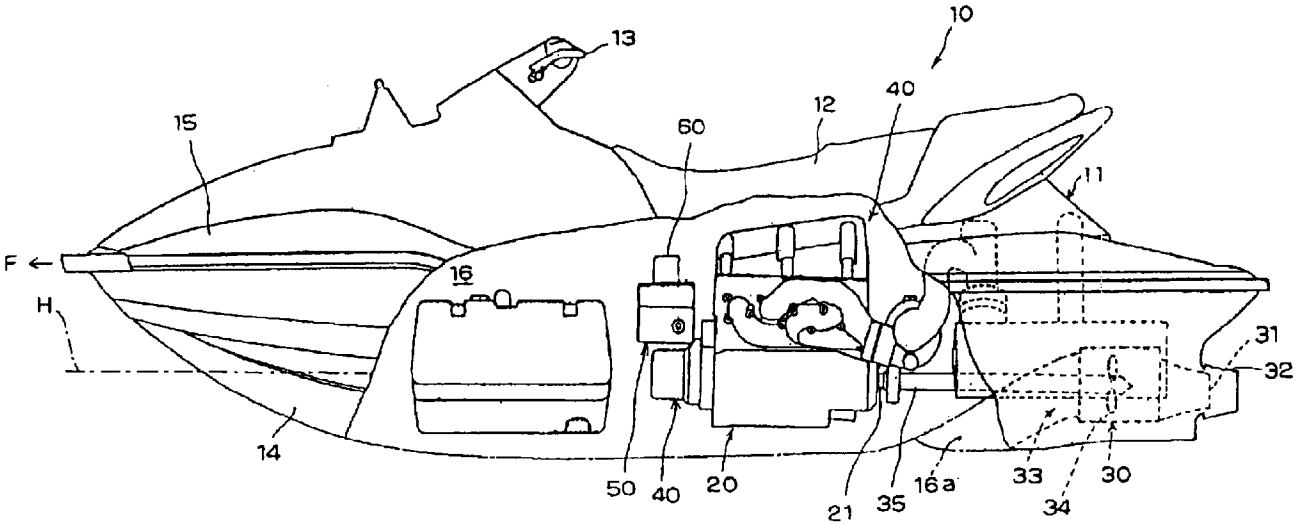
FIG. 1 is a schematic side view, with parts partially omitted, showing one example of a saddle type small-sized boat on which a first embodiment of a lubricating apparatus for a dry sump type engine according to the present invention is mounted.
Figure 2:
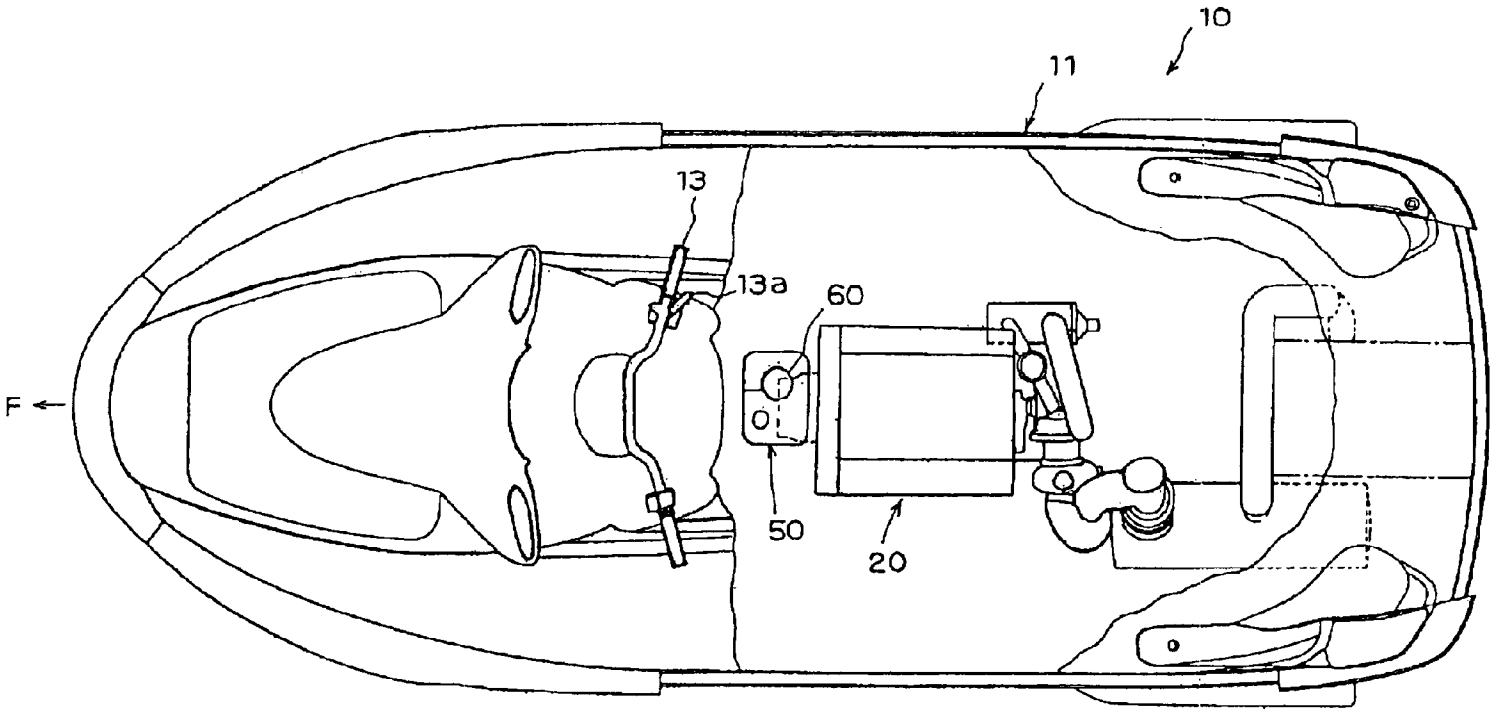
FIG. 2 is a plan view of the small-sized boat shown in FIG. 1.

FIG. 1 is a schematic side view, with parts partially omitted, showing one example of a saddle type small-sized boat on which a first embodiment of a lubricating apparatus for a dry sump type engine according to the present invention is mounted, and FIG. 2 is a plan view of the boat shown in FIG. 1.

Referring to FIGS. 1 and 2, in particularly to FIG. 1, a saddle type small-sized boat 10 can be steered by a crew member who is sitting on a seat 12 provided on a hull 11 while holding a steering handlebar 13 provided with a throttle lever.

The hull 11 has a floating structure in which a lower hull panel 14 is joined to an upper hull panel 15 with an inner space 16 formed therebetween. In the space 16, an engine 20 is mounted on the lower hull panel 14, and a jet pump 30 as propelling means driven by the engine 20 is provided on a rear portion of the lower hull panel 14.

The jet pump 30 has a flow passage 33 extending from a water suction port 16*a* opened in the hull's bottom to a jet port 31, opened in a rear end of the hull 11, and a nozzle 32. An impeller 34 is provided in the flow passage 33. A shaft 35 of the impeller 34 is connected to a rear end of a crank shaft 21 of the engine 20. When the impeller 34 is rotated by the engine 20, water sucked from the water suction port 16a is jetted from the jet port 31 via the nozzle 32, to propel the hull 11. The engine speed, that is, the propelling force generated by the jet pump 30 is operated by turning a throttle lever 13*a* (see FIG. 2) of the steering handlebar 13. The nozzle 32 is connected to the steering handlebar 13 via an operational wire, and is turned by operating the steering handlebar 13, to change the sailing course.

Figure 3:
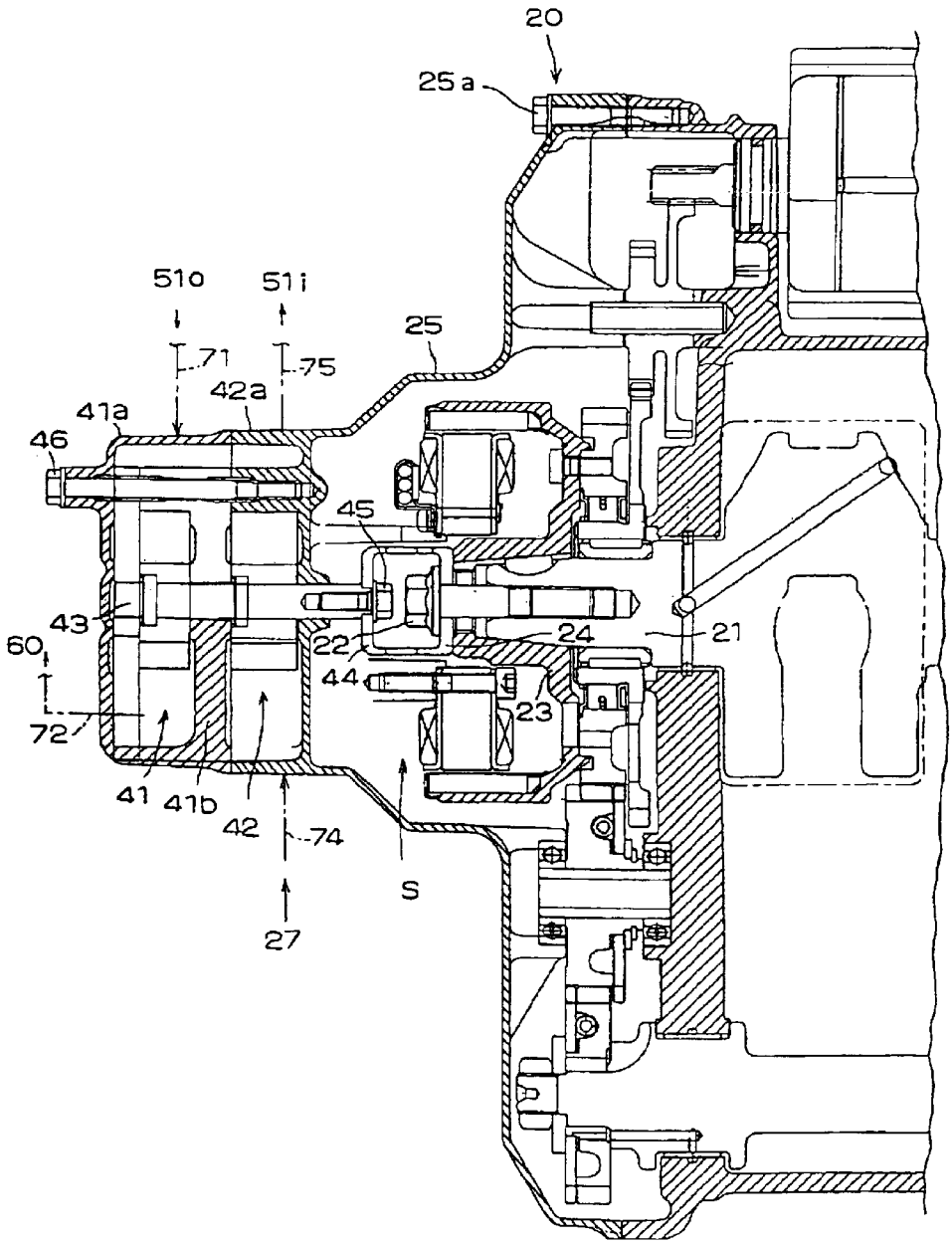
FIG. 3 is a sectional view of a front portion of an engine 20.
Figure 4:
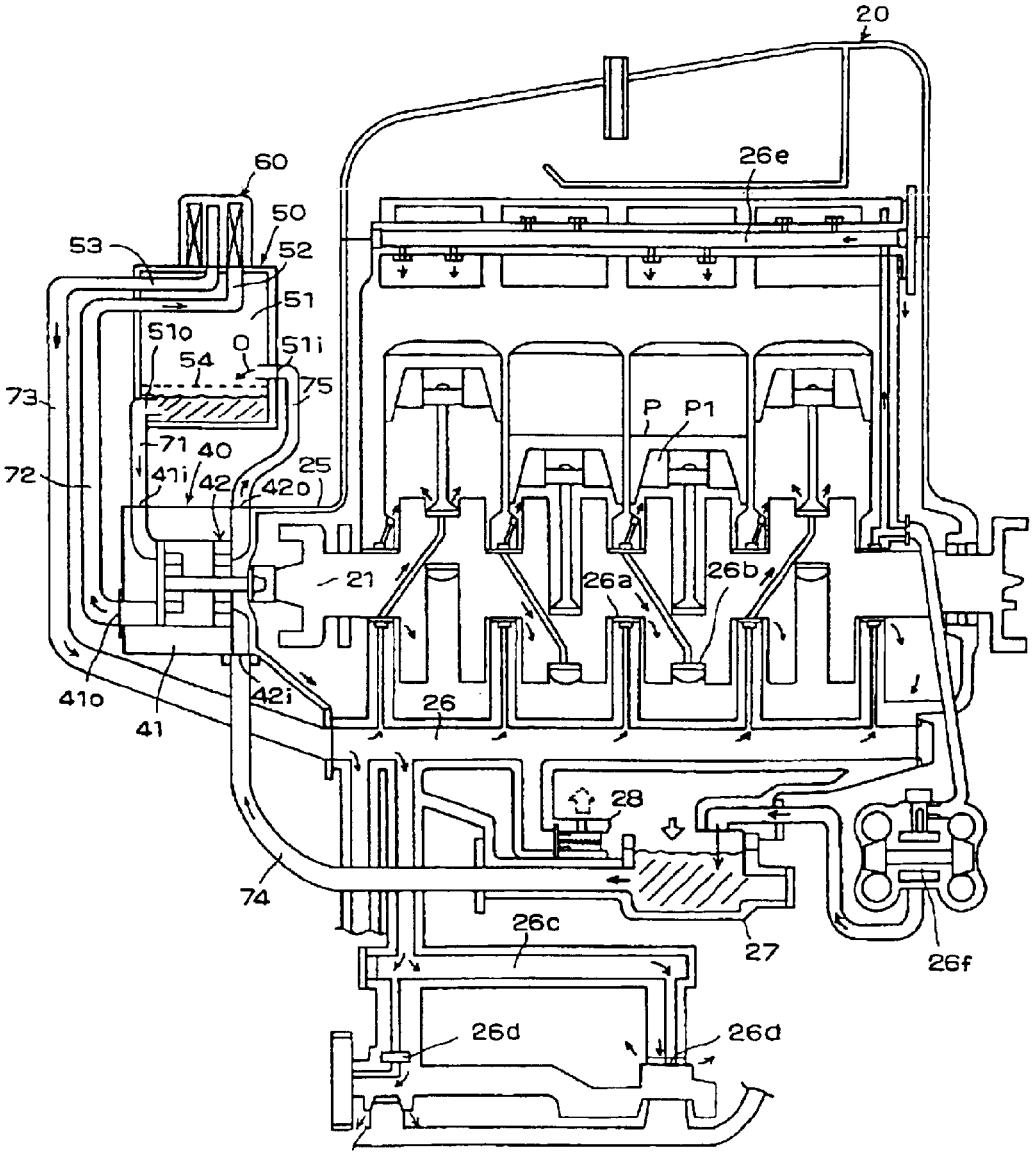
FIG. 4 is a diagram showing an oil circulation path.

FIG. 3 is a transverse sectional view of a front portion of the engine 20, and FIG. 4 is a view showing a circulation path of oil in the lubricating apparatus of the dry sump type engine according to this embodiment.

Referring to FIG. 4, the lubricating apparatus for the dry sump type engine includes the engine 20, an oil pump 40 provided on the engine 20, an oil tank 50 connected to the oil pump 40, an oil filter 60 mounted to the oil tank 50. Furthermore, pipes connecting the above members to each other are provided.

The engine 20 is configured as the dry sump type four-cycle engine having a dual overhead cam (DOHC) type in-line four-cylinder structure. On the front portion (sailing direction of the hull 11 or left side of each of FIGS. 1 to 3) of the engine 20, the oil pump 40 is disposed on the extension of the crank shaft 21.

Referring to FIGS. 3 and 4, the oil pump 40 includes an oil supply pump 41 and an oil recovery pump 42. Both of the pumps 41 and 42 are rotated by the crank shaft 21 via a common shaft (pump shaft) 43.

A joint member 44 is fixed to a rear end portion of the pump shaft 43 with a bolt 45. Furthermore, a joint member 24 is fixed to a front end portion of the crank shaft 21 with a bolt 22. The joint member 24 on the crank shaft 21 side and an ACG rotor 23 provided on the front end portion of the crank shaft 21 are co-fastened to the front end portion of the crank shaft 21 with a bolt 22.

Referring to FIG. 3, a casing 42*a* of the oil recovery pump 42 is integrally formed on a front cover 25 of the engine 20. Furthermore, a casing 41*a* of the oil supply pump 41 is fixed to the casing 42*a* of the oil recovery pump 42 with a plurality of bolts 46 (only one is shown in FIG. 3). A wall 41*b*, opposed to the oil recovery pump 42, of the oil supply pump 41 forms part of the casing of the oil recovery pump 42 and also forms a partition wall between the oil supply pump 41 and the oil recovery pump 42.

The front cover 25 is fixed to a front portion of the engine 20 with a plurality of bolts 25*a* (only one is shown in FIG. 3). When the front cover 25 is fixed to the front portion of the engine 20, the joint member 44 on the pump shaft 43 side is joined to the joint portion 24 on the crank shaft 21 side in the front cover 25.

Referring to FIGS. 1, 2 and 4, the oil tank 50 is disposed directly over the oil pump 40, and the oil filter 60 is provided on an upper surface of the oil tank 50.

Referring to FIG. 4, the oil tank 50 has a sump 51, an oil supply passage 52, formed over the sump 51, for supplying oil to the oil filter 60 therethrough. Furthermore, the oil tank 50 has an oil discharge passage 53 for discharging oil from the oil filter 60 therethrough.

The sump 51 has an oil inlet 51*i* and an oil outlet 51*o*. A strainer 54 for straining oil recovered from the inlet 51*i* into the tank 50 is provided at a position under the inlet 51*i* and over the outlet 51*o*.

The outlet 51*o* is connected via a pipe 71 to a suction port 41*i* of the oil supply pump 41. A discharge port 41*o* of the oil supply pump 41 is connected via a pipe 72 to the oil supply passage 52 for supplying oil to the oil filter 60 therethrough. The oil discharge passage 53 for discharging oil from the oil filter 60 therethrough is connected to a main gallery 26 of the engine 20 via a pipe 73. Oil having been supplied from the main gallery 26 to respective portions of the engine 20 is recovered in an oil pan 27. The oil pan 27 is connected to a suction port 42*i* of the oil recovery pump 42 via a pipe 74, and a discharge port 42*o* of the oil recovery pump 42 is connected to the inlet 51*i* of the oil tank 50.

Accordingly, the entire oil circulation path is as follows: oil tank 50→oil supply pump 41→oil filter 60→main gallery 26 of engine 20→respective portions of engine 20→oil pan 27 of engine 20→oil recovery pump 42→oil tank 50.

The oil supply paths from the main gallery 26 of the engine 20 to respective portions of the engine 20 will be briefly described below.

The oil supply paths from the main gallery 26 are configured as the first, second, third, and fourth paths.

By way of the first path, oil flows from the main gallery 26 to the crank shaft 21 to lubricate a bearing portion 26*a* of the crank shaft 21 and a connection portion 26*b* between a crank pin and a connecting rod and to jet to a back side P1 of a piston P, and returns to the oil pan 27.

By way of the second path, oil flows from the main gallery 26 to a balancer via a sub-gallery 26*c* to lubricate a bearing portion 26*d* of the balancer, and returns to the oil pan 27.

By way of the third path, oil flows from the main gallery 26 to a flow passage 26*e* in a cam shaft to lubricate a cam mechanism (valve mechanism), and returns to the oil pan 27.

By way of the fourth path, oil flows from the main gallery 26 to a turbo charger to lubricate a shaft portion 26*f* of the turbo charger, and returns to the oil pan 27.

The main gallery 26 is provided with a relief valve 28.

Figure 5:
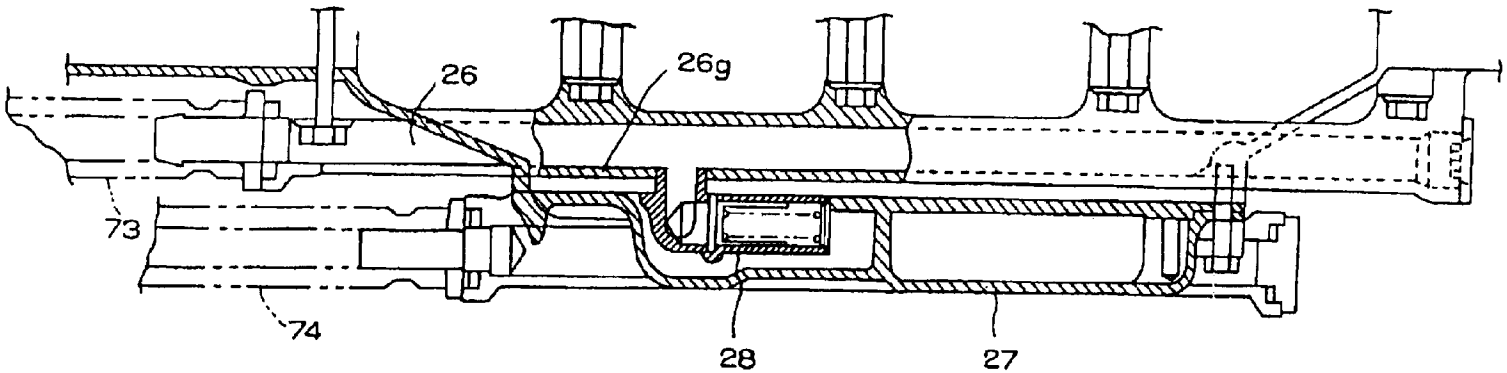
FIG. 5 is an enlarged vertical sectional view showing a main gallery 26, an oil pan 27, and a relief valve 28 of the engine 20.
Figure 6A:
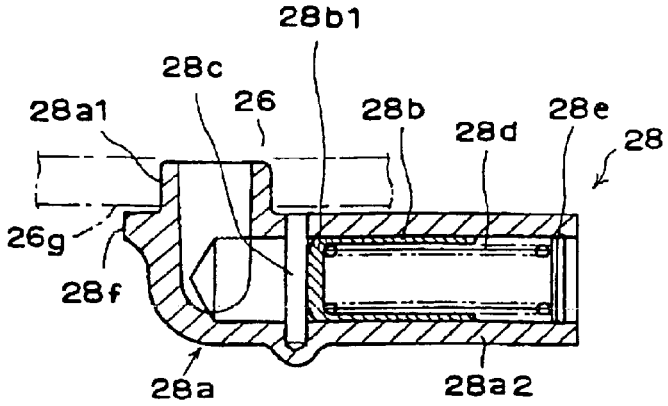
FIGS. 6(*a*) to 6(*d*) are views showing the relief valve 28, wherein FIG. 6(*a*) is a vertical sectional view.
Figure 6B:
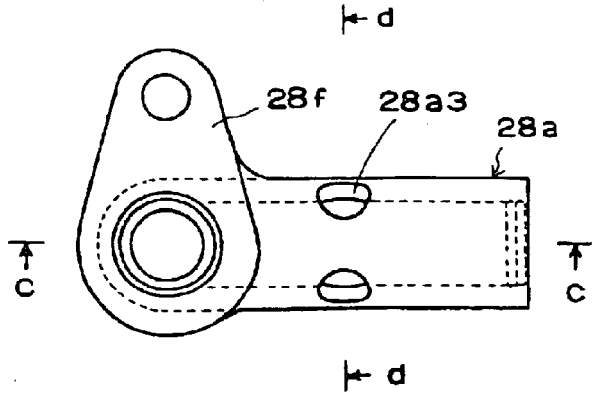
Figure 6D:
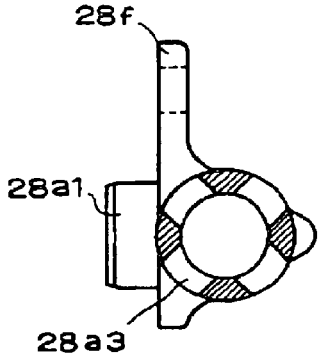
Figure 6C:
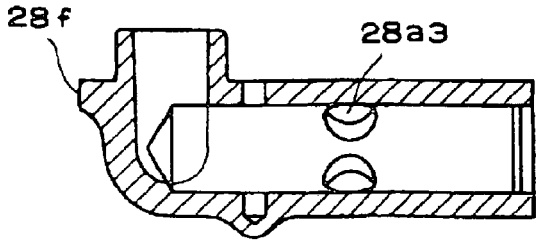
Figure 8:
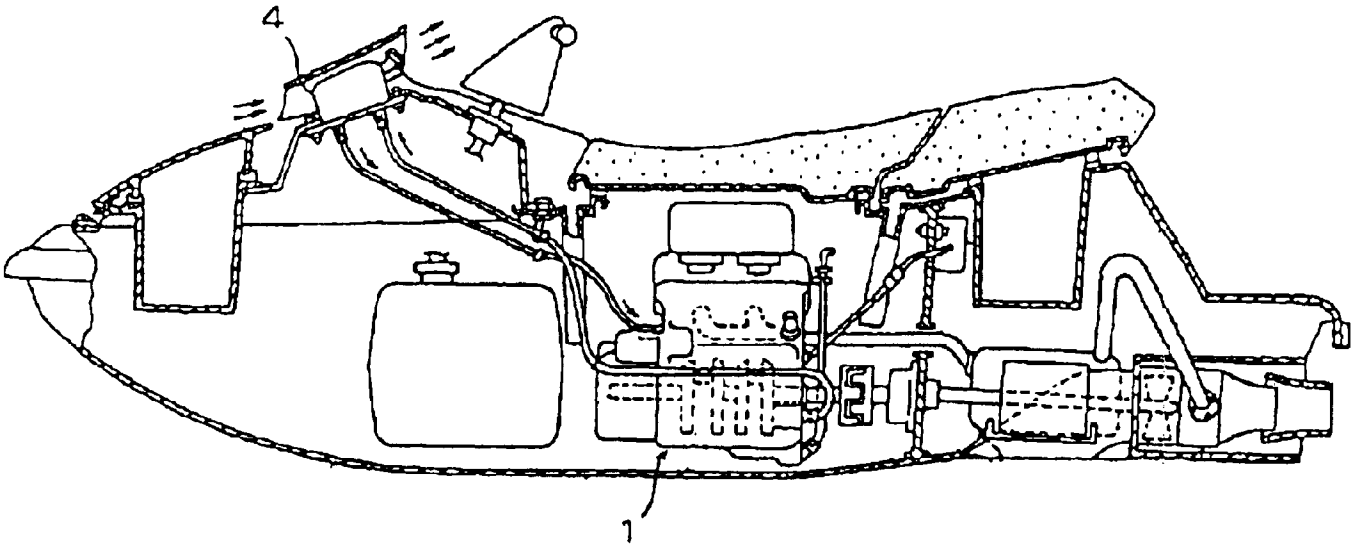
FIG. 8 RELATED ART
FIG. 8 is a view illustrating a related art lubricating apparatus.

FIG. 5 is an enlarged vertical sectional view showing the main gallery 26, oil pan 27, and relief valve 28 of the engine 20. FIGS. 6(*a*) to 6(*d*) are views showing the relief valve 28, wherein FIG. 6(*a*) is a vertical sectional view; FIG. 6(*b*) is a plan view of a body; FIG. 6(*c*) is a sectional view taken on line c-c of FIG. 6(*b*); and FIG. 6(*d*) is a sectional view taken on line d-d of FIG. 6(*b*).

Referring to FIGS. 6(*a*) to 6(*d*), the relief valve 28 is formed into a cylindrical shape which is longer in the horizontal direction (from right to left in FIG. 6) as a whole. Referring to FIGS. 4 and 5, the relief valve 28 is disposed substantially in the horizontal direction and in parallel to the main gallery 26 which is disposed in parallel to the crank shaft 21 of the engine 20.

The relief valve 28 includes an approximately L-shaped body 28*a* composed of a short-pipe 28*a*1 and a long-pipe 28*a*2; a cylindrical valve body 28*b* slidably inserted in the long-pipe 28*a*2 of the body 28*a*; a pin-like stopper 28*c* for restricting the movement range of the valve body 28*b*; a spring 28*d* for biasing the valve body 28*b* toward the stopper 28*c*; a ring-like spring stop 28*e* for pressing the spring 28*d*; and a mounting portion 28*f*, formed integrally with the body 28*a*, for mounting the relief valve 28 to a bottom wall portion of the main gallery 26.

The relief valve 28 is, as shown in FIG. 5, mounted to the bottom wall portion, designated by numeral number 26*g*, of the main gallery 26. When the relief valve is mounted to the main gallery 26, the relief valve 28 is disposed in parallel to the main gallery 26 and substantially in the horizontal direction, with the flow passage of the short-pipe 28*a*1 in communication with the main gallery 26.

Accordingly, oil in the main gallery 26 reaches the valve body 28*b* by way of the short-pipe 28*a*1 and the left portion of the long-pipe 28*a*2.

One end 28*b*1 of the valve body 28*b* is closed. In a normal state, the closed end 28*b*1 is kept in a contact state with the stopper 28*c* by a biasing force of the spring 28*d*. If hydraulic pressure in the main gallery 26, which is raised to a specific value or more, is applied to the closed end 28*b*1, the closed end 28*b*1 is slid rightwardly in FIG. 6(*a*) against the biasing force of the spring 28*d*.

As shown in FIGS. 6(*b*), 6(*c*) and 6(*d*), the long-pipe 28*a*2 of the body 28*a* has a discharge port 28*a*3. When the closed end 28*b*1 of the valve body 28*b* is slid rightwardly to open the discharge port 28*a*3, oil is jetted (releaved) from the discharge port 28*a*3, to keep the hydraulic pressure in the main gallery 26 at a suitable value.

The lubricating apparatus for a dry sump type engine, having the above configuration, exhibits the following functions and effects:

(a). Since the cylindrical relief valve 28 is disposed in parallel to the main gallery 26 which is disposed in parallel to the crank shaft 21 of the engine 20, a path extending from the main gallery 26 to the relief valve 28 can be shortened, as compared with the related art structure in which the cylindrical relief valve is disposed perpendicularly to the main gallery which is disposed in parallel to crank shaft.

This makes it possible to enhance the responsiveness of the relief valve, and hence to readily control hydraulic pressure in the main gallery to be kept at a suitable value.

(b). Since the relief valve 28 is disposed in the horizontal direction (substantially in the horizontal direction), the height of the engine 20 can be lowered and thereby the center of gravity of the engine 20 can be lowered, as compared with the related art structure in which the relief valve 28 is disposed in the vertical direction.

(c). Since the strainer 54 for straining oil O recovered in the oil tank 50 is provided in the oil tank 50 (see FIG. 4), foreign matter entrapped in the oil O can be removed by the strainer 54.

The strainer 54 is also effective for separation of air from oil.

The strainer 54 provided in the oil tank 50 is further advantageous due to ease of maintenance as compared with a strainer provided in the engine.

(d). Since the lubricating apparatus for a dry sump type engine is configured such that the oil pump 40 is disposed on the extension of the crank shaft 21 and the joint member 24 provided on the end portion of the crank shaft 21 is connected, on the same axial line, to the joint member 44 provided on the end portion of the shaft 43 of the oil pump 40, the transmission gear required for the related art lubricating apparatus is not required for the lubricating apparatus of the present invention. This makes it possible to drive the oil pump 40 with a simple structure and therefore to reduce the number of parts.

Since the joint members 24 and 44 are connected to each other in the cover 25 of the engine 20, the space S (see FIG.

3) required for connecting the crank shaft 21 to the pump shaft 43 can be decreased in size.

(e). Since the joint members 24 on the crank shaft 21 side are co-fastened with the ACG rotor 23 provided on the end portion of the crank shaft 21, the ACG rotor 23 and the joint member 24 can be efficiently provided, in a small space, on the end portion of the crank shaft 21 with a reduced number of fixing parts.

(f). Since the oil tank 50 connected to the oil pump 40 is disposed directly over the oil pump 40, it is possible to make effective use of the space over the oil pump 40 and hence to make the vicinity of the engine compact. Since the pipes 71, 72 and 75 for connecting the oil pump 40 to the oil tank 50 can be shortened, it is possible to efficiently circulate oil therebetween.

Figure 9:
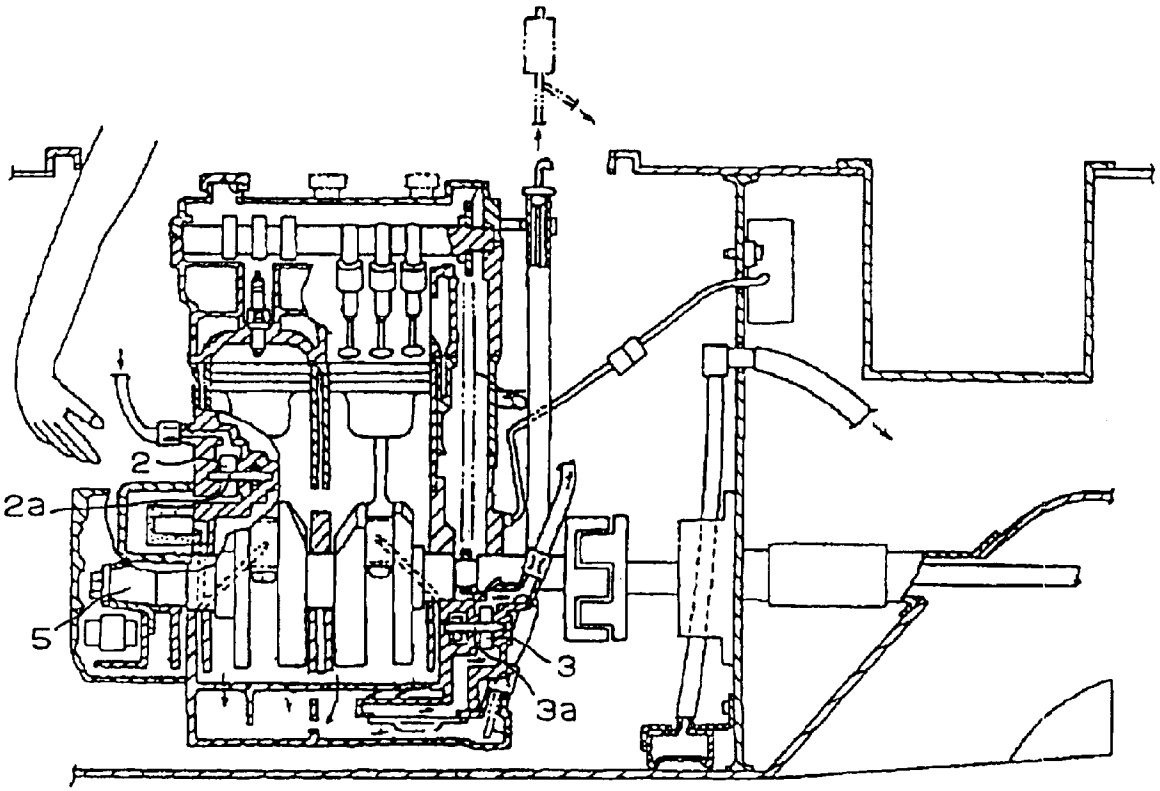
FIG. 9 RELATED ART
FIG. 9 is a view illustrating the related art lubricating apparatus.

(g). Since the oil pump 40 is configured such that the oil supply pump 41 and the oil recovery pump 42 are rotated via the common shaft 43, the engine 20 can be made compact, as compared with the related art lubricating apparatus for a dry sump type engine shown in FIG. 9 in which the oil pumps 2 and 3 disposed on the independent shafts 2*a* and 3*a* are rotated via the shafts 2*a* and 3*a*, respectively.

In addition, in the case where the oil supply pump 41 and the oil recovery pump 42 are rotated via the common shaft 43 just as the lubricating apparatus 20 for a dry sump type engine, the length of the pump 40 in the axial line becomes relatively longer; however, in this embodiment, since the oil tank 50 is disposed directly over the oil pump 40 to make effective use the space over the oil pump 40, it is possible to make the vicinity of the engine 20 compact. Furthermore, it is possible not only to shorten the pipes 71, 72 and 75 for connecting the oil pump 40 to the oil tank SO and hence to improve the oil circulation efficiency, but also to collectively dispose the pipes 71 and 72 for the oil supply pump 41 and the pipe 75 for the oil recovery pump 42 and hence to make the piping structure compact and also make working with the piping easier.

FIGS. 7(*a*) to 7(*d*) are views showing an essential portion of a second embodiment of a lubricating apparatus for a dry sump type engine of the present invention, wherein FIG. 7(*a*) is a schematic plan view of a lower case 50*b* of an oil tank 50 from which an upper case 50*a* is removed; FIG. 7(*b*) is a schematic plan view of the oil tank 50; FIG. 7(*c*) is a schematic vertical sectional view showing the oil tank 50 and part of the engine 20; and FIG. 7(*d*) is a schematic sectional view taken on line d-d of FIG. 7(*b*). In these figures, parts being the same as or similar to those described in the first embodiment are designated by the same characters.

This embodiment is different from the first embodiment only in that a relief valve 55 is provided in the oil tank 50. Accordingly, no relief valve is provided in the oil pan 27 in this embodiment.

In this embodiment, an oil supply passage 52 is provided for supplying oil from an oil tank 50 to an oil filter 60. At a mounting portion 50*c* to which the oil filter 60 is mounted, a flow passage 52*a* formed into an approximately C-shape in a plan view is communicated to an inner end portion of the oil supply passage 52. Oil is supplied to the oil filter 60 via the C-shaped flow passage 52*a*. The oil thus supplied to the oil filter 60 flows from an outlet pipe 61 of the oil filter 60 to a pipe 73 via a discharge passage 53. Since the outlet pipe 61 flows between both ends 52*b* of the C-shaped flow passage 52*a*, it does not interfere with the C-shaped flow passage 52*a*.

The C-shaped flow passage 52*a* is provided with a branch passage 52*c*, and a relief valve 55 is connected to a pipe 52*d* integrated with an upper case 50*a* which forms the branch passage 52*c*.

The relief valve 55 is provided upright on an inner bottom surface of a lower case 50*b* of the oil tank 50, and an oil lead pipe 55*a* of the relief valve 55 is connected to the pipe 52*d*. The connection between the oil lead pipe 55*a* and the pipe 52 is established when the upper case 50*a* is mounted to the lower case 50*b*.

A basic structure of the relief valve 55 and its operation are the same as those of the above-described relief valve 28.

That is to say, the relief valve 55 includes the lead pipe 55*a* equivalent to the body 28*a* of the relief valve 28; a cylindrical valve body 28*b* slidably inserted in the lead pipe 55*a*; a pin-like stopper 28*c* for restricting the movement range of the valve body 28*b*; a spring 28*d* for biasing the valve body 28*b* toward the stopper 28*c*; and a ring-like spring stopper 28*e* for pressing the spring 28*d*. A flow passage of the lead pipe 55*a* is in communication with the oil supply passage 52 for the oil filter 60 via the branch passage 52*a* and C-shaped flow passage 52*a*.

Accordingly, oil in the oil supply passage 52 reaches the valve body 28*b* through the lead pipe 55*a*.

One end 28*b*1 of the valve body 28*b* is closed. In a normal state, the closed end 28*b*1 is kept in the contact state with the stopper 28*c* by a biasing force of the spring 28*d*. If hydraulic pressure in the oil supply passage 52, which is raised to a specific value or more, is applied to the closed end 28*b*1, the closed end 28*b*1 is slid leftwardly in FIG. 7(*d*) against the biasing force of the spring 28*d*, to open the discharge port 28*a*3. As a result, oil is jetted (releaved) from the discharge port 28*a*3 into the oil tank 50, to keep the hydraulic pressure in the oil supply passage 52 at a suitable value.

In FIGS. 7(*a*), 7(*c*) and 7(*d*), reference numeral 56 designates a cooling water passage which passes through the inner bottom portion of the lower case 50*b* of the oil tank 50.

According to this embodiment, since the relief valve 55 for a dry sump type engine is provided in the oil tank 50, the height of the engine 20 can be lowered and thereby the center of gravity of the engine 20 can be lowered, as compared with the structure in which the relief passage and the relief valve are provided in the engine 20.

In addition, this embodiment characterized in that oil is directly discharged in the oil tank 50 exhibits the following function and effect:

In the structure in which the relief valve is provided in the engine and oil is discharged in the engine, scattered oil in the engine is increased to reduce the oil recovery rate, with a result that it is required to increase the overall amount of oil to be circulated.

On the contrary, according to this embodiment, since the relief valve 55 is provided in the oil tank 50 and oil is directly discharged in the oil tank 50, it is possible to improve the oil recovery rate and hence to reduce the overall amount to be circulated.

While the preferred embodiments of the present invention have been described, such description is for illustrative purposes only, and it is to be understood that variations may be suitably made without departing from the scope of the present invention.

What is claimed is:

1. A lubricating apparatus for a horizontally disposed dry sump engine comprising:

an oil tank mounted on an end of said engine, so as to reduce a vertical height of said engine; and a relief valve provided in said oil tank wherein said relief valve further comprises:

a lead pipe, said lead pipe being connectable to an outlet pipe of an oil filter, said lead pipe including a discharge port formed therein;

a cylindrical valve body slidably inserted in said lead pipe;

a stopper for restricting movement of said cylindrical valve body in said lead pipe;

a spring for biasing said cylindrical valve body toward said stopper; and a spring stop for pressing said spring;

wherein said cylindrical valve body is received within an L-shaped body comprising the lead pipe and when moved against the bias of said spring, said discharge port is opened to allow hydraulic pressure in the outlet of the oil filter to be relieved.

2. A lubricating apparatus for a dry sump engine, according to claim 1, further comprising:

a strainer for straining oil recovered in said oil tank provided in said oil tank.

* * * * *